US009885370B2

(12) United States Patent
Fang et al.

(10) Patent No.: US 9,885,370 B2
(45) Date of Patent: Feb. 6, 2018

(54) DIFFUSER

(71) Applicant: Johnson Electric S.A., Murten (CH)

(72) Inventors: Chuan Hui Fang, Hong Kong (CN); Feng Liu, Shenzhen (CN); Xiao Hong Ye, Shenzhen (CN); Feng Xue, Shenzhen (CN); Wei Sun, Shenzhen (CN)

(73) Assignee: Johnson Electric S.A., Murten (CH)

( * ) Notice: Subject to any disclaimer, the term of this patent is extended or adjusted under 35 U.S.C. 154(b) by 179 days.

(21) Appl. No.: 14/706,633

(22) Filed: May 7, 2015

(65) Prior Publication Data

US 2015/0322964 A1 Nov. 12, 2015

(30) Foreign Application Priority Data

May 7, 2014 (CN) ..... 2014 1 0189647

(51) Int. Cl.

| | |
|---|---|
| ***F04D 29/62*** | (2006.01) |
| ***F04D 29/44*** | (2006.01) |
| ***F04D 17/08*** | (2006.01) |
| ***F04D 25/02*** | (2006.01) |
| ***F04D 29/28*** | (2006.01) |
| ***F04D 29/053*** | (2006.01) |
| ***F04D 29/42*** | (2006.01) |

(Continued)

(52) U.S. Cl.

CPC ..... *F04D 29/626* (2013.01); *F04D 17/08* (2013.01); *F04D 25/02* (2013.01); *F04D 25/08* (2013.01); *F04D 29/053* (2013.01); *F04D 29/281* (2013.01); *F04D 29/4206* (2013.01); *F04D 29/444* (2013.01); *F04D 29/282* (2013.01); *F04D 29/30* (2013.01)

(58) Field of Classification Search

CPC ..... F04D 29/444; F04D 17/08; F04D 25/02; F04D 25/08; F04D 29/053; F04D 29/281; F04D 29/4206; F04D 29/626; F04D 29/282; F04D 29/30

USPC ..... 415/208.2–4, 211.1; 416/185, 186 R, 416/223 B

See application file for complete search history.

(56) References Cited

U.S. PATENT DOCUMENTS 4,057,370 A * 11/1977 Numata ..... F04D 29/441 415/119

5,714,819 A * 2/1998 Gilliland ..... A47L 5/22 310/58

(Continued)

*Primary Examiner* — Woody Lee, Jr.
*Assistant Examiner* — Behnoush Haghighian
(74) *Attorney, Agent, or Firm* — Muncy, Geissler, Olds & Lowe, P.C.

(57) ABSTRACT

A diffuser includes a body and diffusion blades disposed at a circumferential edge of the body. The body includes an air inlet side and an air outlet side. Each diffusion blade has an inclined guide surface. The guide surface has a starting end at the air inlet side of the body and a terminating end adjacent the air outlet side of the body. The guide surface extends from the starting end to the terminating end along a circumferential path and has a width gradually increasing from the starting ending to the terminating end. The diffuser further includes air outlets at the terminating ends of the guide surfaces. Each air outlet fluidly connects the terminating end of a corresponding one of the guide surfaces and the air outlet side of the body. A blower employing the diffuser is also provided.

12 Claims, 4 Drawing Sheets

(51) Int. Cl.
*F04D 25/08* (2006.01)
*F04D 29/30* (2006.01)

(56) References Cited

U.S. PATENT DOCUMENTS

| | | | | | |
|---|---|---|---|---|---|
| 5,734,214 | A * | 3/1998 | Gilliland | F04D 25/06 | 310/194 |
| 6,166,462 | A * | 12/2000 | Finkenbinder | F04D 29/441 | 310/63 |
| 6,296,459 | B1 * | 10/2001 | Saputo | F04D 17/164 | 415/208.2 |
| 8,317,497 | B2 * | 11/2012 | Finkenbinder | F04D 25/06 | 415/199.3 |
| 2008/0014080 | A1 * | 1/2008 | Fang | A47L 5/22 | 415/191 |
| 2013/0251560 | A1 * | 9/2013 | Xue | F04D 13/06 | 417/410.1 |
| 2015/0214802 | A1 * | 7/2015 | Kim | H02K 21/16 | 318/139 |

* cited by examiner

DIFFUSER

CROSS REFERENCE TO RELATED APPLICATIONS

This non-provisional patent application claims priority under 35 U.S.C. §119(a) from Patent Application No. 201410189647.3 filed in The People's Republic of China on May 7, 2014, the entire contents of which are hereby incorporated by reference.

FIELD OF THE INVENTION

This invention relates to a diffuser, as used in a blower or the like.

BACKGROUND OF THE INVENTION

Blowers are commonly used in appliances such as hand dryers and vacuum cleaners to provide airflow. A typical blower includes a housing with a motor, diffuser and impeller mounted therein. The impeller and the motor are respectively disposed at opposite sides of the diffuser. The motor rotates the impeller to produce the airflow. The airflow enters an air inlet of the impeller via an inlet of the housing. The diffuser guides the airflow from the impeller to the motor side where the air escapes through an outlet of the housing.

The design of the diffuser is of critical importance because it directly affects the efficiency of the blower. High efficiency diffusers can increase the amount of airflow or reduce the power consumed to provide the same amount of airflow.

Thus, there is a desire for a diffuser for a blower that can increase the efficiency of the blower.

SUMMARY OF THE INVENTION

Accordingly, in one aspect thereof, the present invention provides a diffuser comprising: a plate-shaped body, the body comprising an air inlet side and an air outlet side; a plurality of diffusion blades disposed at an circumferential edge of the body, each of the diffusion blades comprises an inclined guide surface, the guide surface having a starting end at the air inlet side of the body and a terminating end at the air outlet side of the body, the guide surface extending from the starting end to the terminating end along a circumferential path of the body and has a width gradually increasing from the starting end to the terminating end; and a plurality of air outlets at the terminating ends of the guide surfaces of the diffusion blades, each of the air outlets fluidly connects the terminating end of a corresponding one of the guide surfaces and the air outlet side of the body, wherein the body comprises an air inlet surface at the air inlet side, and the guide surface is inclined with respect to the air inlet surface at an inclination angle ranging between 18 to 25 degrees.

Preferably, each of the diffusion blades further comprises a curved connecting wall interconnecting an inner edge of the guide surface and the body, the curved connecting wall comprises a starting end connected with the starting end of the guide surface and a terminating end connected with the terminating end of the guide surface, and the connecting wall gradually departs from an outer edge of the guide surface to form the curved shape.

Preferably, the curved connecting wall comprises a plurality of curved sections having different radii of curvature.

Preferably, the curved connecting wall has an inlet angle ranging between 16 to 23 degrees.

Preferably, wherein the curved connecting wall has an outlet angle ranging between 28 to 36 degrees.

Preferably, the body comprises an air inlet surface at the air inlet side, an air outlet surface at the air outlet side, and an outer circumferential surface interconnecting circumferential edges of the air inlet surface and the air outlet surface, a projection of the outer circumferential surface along a center axis of the body is a circle in shape, and outer edges of the guide surfaces of the diffusion blades are located on the circle.

Preferably, the body comprises an air outlet surface at the air outlet side, the air outlet surface defines a cavity in flow communication with the air outlets.

Preferably, the diffuser further comprises a plurality of mounting posts disposed at the air outlet side.

According to a second aspect, the present invention provides a blower comprising: a motor having an output shaft; an impeller fixed to the output shaft to be driven to generate an airflow; and the diffuser of Claim 1 disposed downstream of the impeller in the direction of the airflow and an outer housing that houses the impeller and diffuser.

Preferably, the impeller comprises a plurality of fan blades, each of the fan blades having an outlet angle ranging between 22 to 35 degrees.

Preferably, the motor is mounted in a motor housing, one end of the housing is fixed to the outer housing, and the other end of the motor housing forms a pair of diametrically-opposed air ports.

Preferably, the motor is a universal motor comprising a pair of diametrically-opposed brushes, the brushes deviating from the air ports of the motor housing.

In view of the foregoing, the diffuser of the present invention is optimally configured to be well matched with the impeller. Each diffusion blade has an appropriately-sized flow passage with small flow resistance, thus achieving a good diffusion result. Therefore, the efficiency of the blower is greatly enhanced.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
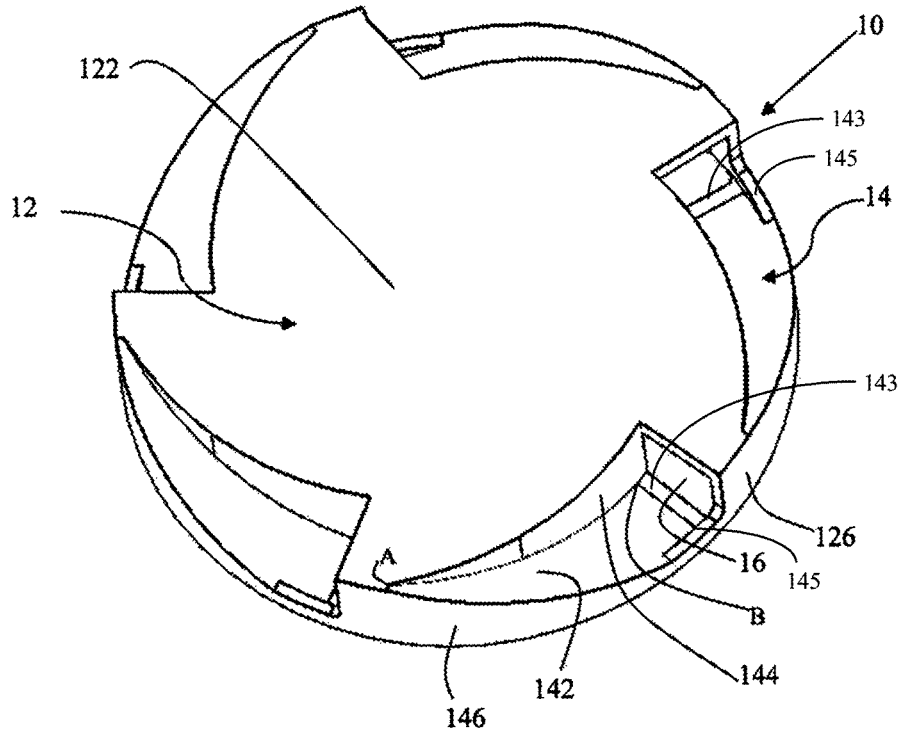
FIG. 1 illustrates a diffuser according to the preferred embodiment of the present invention, viewed from the top.
Figure 2:
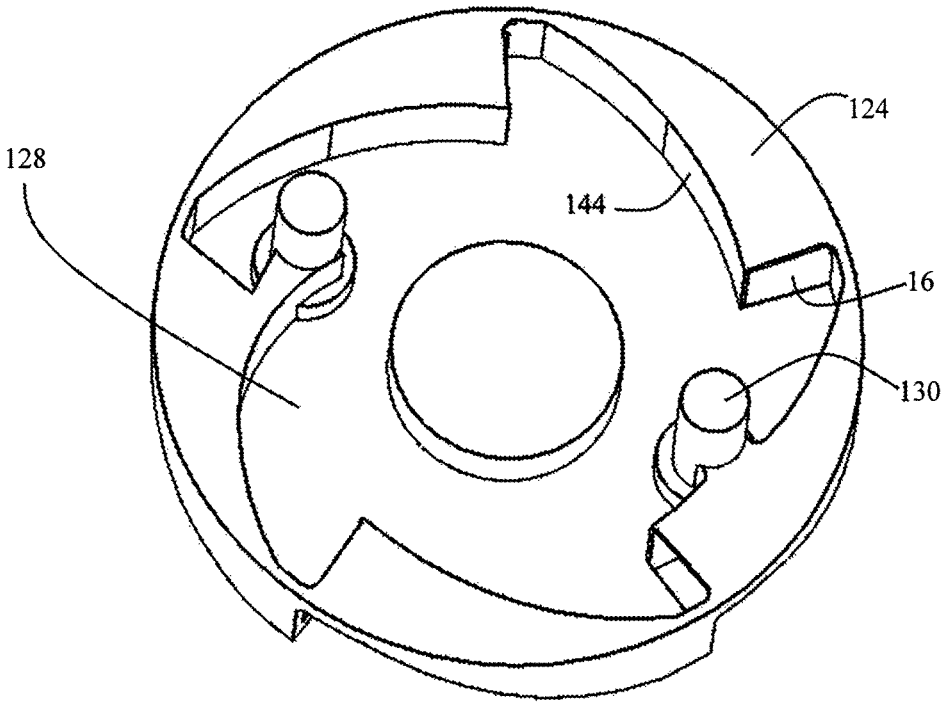
FIG. 2 illustrates the diffuser of FIG. 1, viewed from below.

Referring to FIG. 1 and FIG. 2, a diffuser 10 according to the preferred embodiment, includes a plate-shaped body 12 and a plurality of diffusion blades 14 disposed along a circumferential edge of the body 12.

The body 12 includes a first surface or air inlet surface 122, a second surface or air outlet surface 124 opposite the air inlet surface 122, and an outer circumferential surface 126 interconnecting circumferential edges of the air inlet surface 122 and the air outlet surface 124. A side of the body 12 containing the air inlet surface 122 is called the air inlet side, and a side of the body 12 containing the air outlet surface 122 is called the air outlet side. Preferably, a projection of the outer circumferential surface 126 along an axial direction of the diffuser is a closed circle in shape. The axial direction of the diffuser is the axial direction of the blower to which the diffuser is to be fitted.

Each diffusion blade 14 includes a guide surface 142 and a connecting wall 144 disposed at an inner side of the guide surface 142 and connected with the body 12.

The guide surface 142 is an inclined surface oriented toward the air inlet side of the body 12, which has a starting end adjacent an outer edge of the air inlet surface 122 of the body 12 and a terminating end adjacent an outer edge of the air outlet surface 124. The guide surface 142 extends from the starting end to the terminating end along the circumferential direction, with its width gradually increasing from the starting end to the terminating end. The guide surface 142 has an outer edge 146 located on the outer circumferential surface 126 of the body 12. Each of the diffusion blades 14 further includes a sloping surface 143 extending from the terminating end of a corresponding one of the guide surfaces 142 toward the air inlet side of the body 12.

The connecting wall 144 connects the inner edge of the guide surface 142 to the body 12. Specifically, the connecting wall 144 extends from the air inlet surface 122 to the air outlet surface 124 of the body 12 in an axial direction of the diffuser. A starting end of the connecting wall 144 is connected with the starting end of the guide surface 142, and a terminating end of the connecting wall 144 is connected with the terminating end of the guide surface 142. From the starting end to the terminating end, the connecting wall 144 gradually departs from the outer circumferential surface 126 to form a curved shape and make the width of the guide surface 142 gradually increase. The curved connecting wall 144 may include multiple curved sections. In this embodiment, the curved connecting wall 144 is formed by two curved sections. However, the curved connecting wall may be made by three or four curved section. Each curved section has a different radius. The use of multiple curved sections allows the air channel to gently change the direction of the air while being easier to manufacture than a curve with a continuously changing radius.

The air outlet surface 124 of the body 12 is recessed to form a cavity 128 bounded by inner surfaces of the connecting walls 144.

An air outlet 16 is formed between the terminating end of each connecting wall 144, the terminating end of one corresponding guide surface 142, the outer circumferential surface 126 of the body and the air inlet surface 122 of the body. Each air outlet 16 is in flow communication with the cavity 128, such that air introduced from the starting end of the guide surface 142, after flowing over the guide surface 142, can enter the cavity 128 at the air outlet side of the body via the air outlet 16 adjacent the terminating end 16 of the guide surface 142.

A plurality of mounting posts 130 is disposed on the air outlet surface 124 of the diffuser 10, for mounting the diffuser 10 to another device, as described below. Each of the diffusion blades 14 further includes an outer wall 145 extending from a rim of one air outlet 16 along an outer edge of the guide surface 142.

Figure 3:
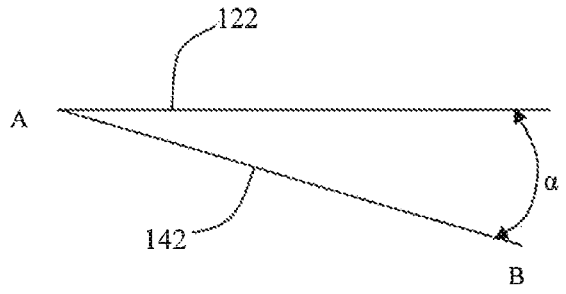
FIG. 3 is a vector diagram of a part of the diffuser of FIG. 1.

FIG. 3 illustrates an inclination angle of the guide surface of the diffuser of FIG. 1. In this disclosure, the inclination angle of the guide surface refers to an angle $\alpha$ between a projection of the inner edge of the guide surface 142 and a projection of the air inlet surface 122 on an axial plane on which the starting end A of the guide surface 142 and a center of the body 12 are located. Preferably, the inclination angle $\alpha$ of the guide surface ranges between 18 to 25 degrees. In this embodiment, the guide surface 142 is a flat surface inclined from the starting end A toward the terminating end B, with same height at the inner edge and outer edge thereof. It should be understood that the guide surface 142 may be slightly inclined inwardly or outwardly. Furthermore, the guide surface 142 is not intended to be limited to the flat surface. Rather, the guide surface 142 may for example be a slightly concave-curved or convex-curved surface.

Figure 4:
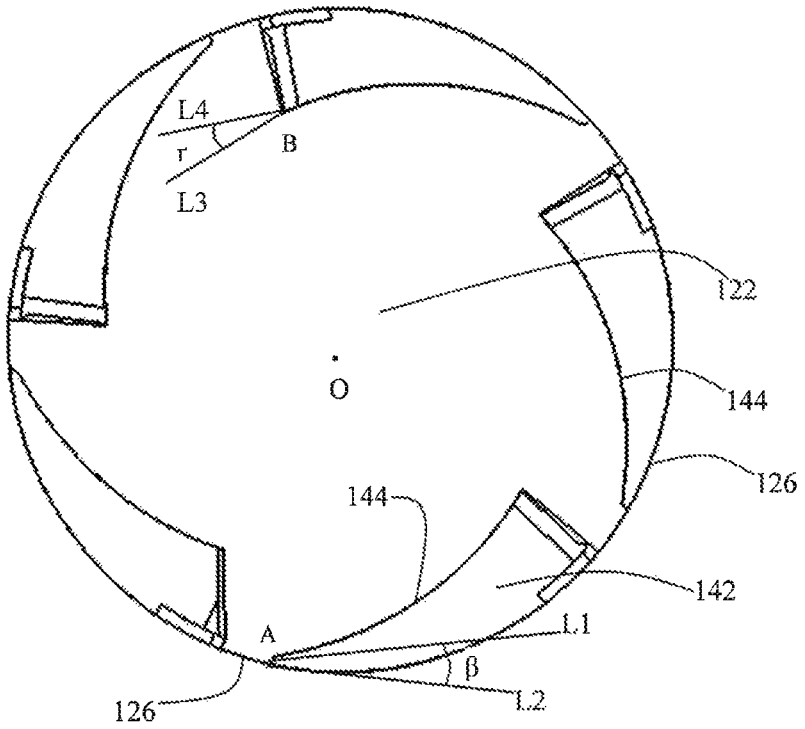
FIG. 4 is a plan of the diffuser of FIG. 1.

FIG. 4 is a top plan view of FIG. 1. A tangent line L1 of the inner edge of the guide surface 142 at the starting end A and a tangent line L2 of a circle, formed by the diffuser, at the starting end A form an angle $\beta$, referred to as the inlet angle, wherein the circle has a center at a center O of the body 12 and a radius equal to the distance between the starting end A of the inner edge of the guide surface 142 and the body center O. Preferably, the inlet angle $\beta$ ranges between 16 to 23 degrees. A tangent line L3 of the inner edge of the guide surface 142 at the terminating end B and a tangent line L4 of a circle at the terminating end B form an angle r, referred to as the outlet angle, wherein the circle has a center at the body center O and a radius equal to the distance between the terminating end B of the inner edge of the guide surface 142 and the body center O. Preferably, the outlet angle r ranges between 28 to 36 degrees.

In the diffuser exemplified above, each diffusion blade has an appropriately-sized flow passage with small flow resistance, thus achieving a good diffusion result.

Figure 5:
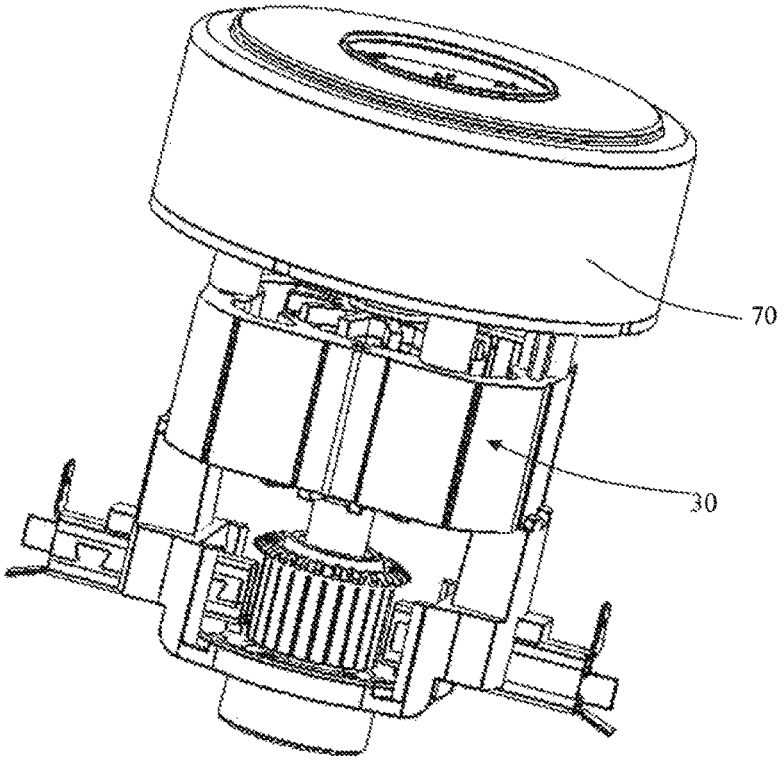
FIG. 5 illustrates a blower employing the diffuser of FIG. 1, in a partially assembled state.
Figure 6:
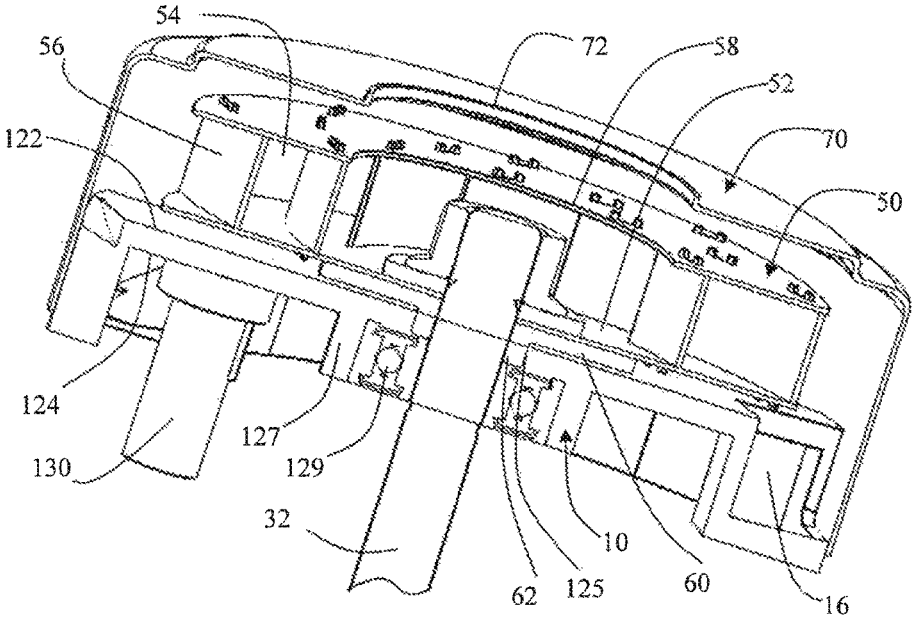
FIG. 6 is a sectional view of the blower of FIG. 5 with the motor removed.
Figure 7:
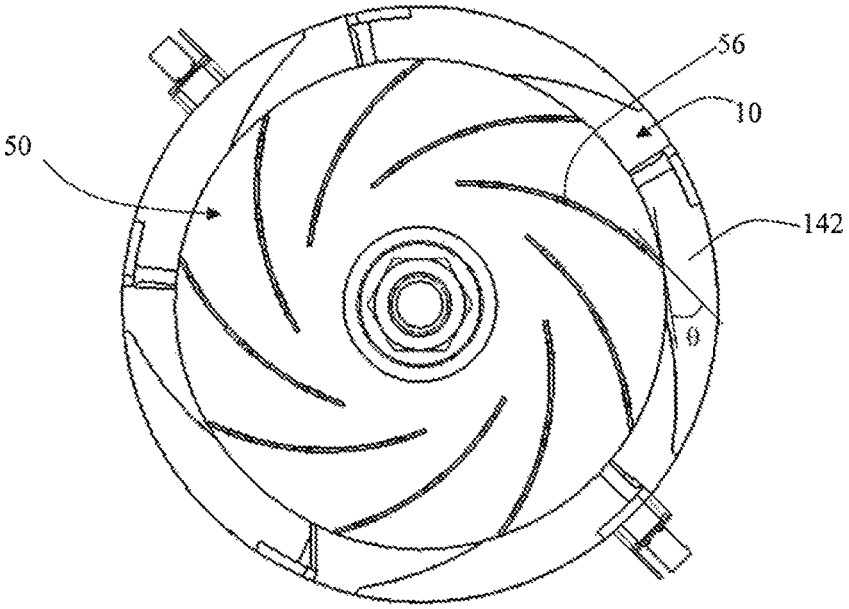
FIG. 7 is a plan view of the blower of FIG. 5 with an outer housing removed.
Figure 8:
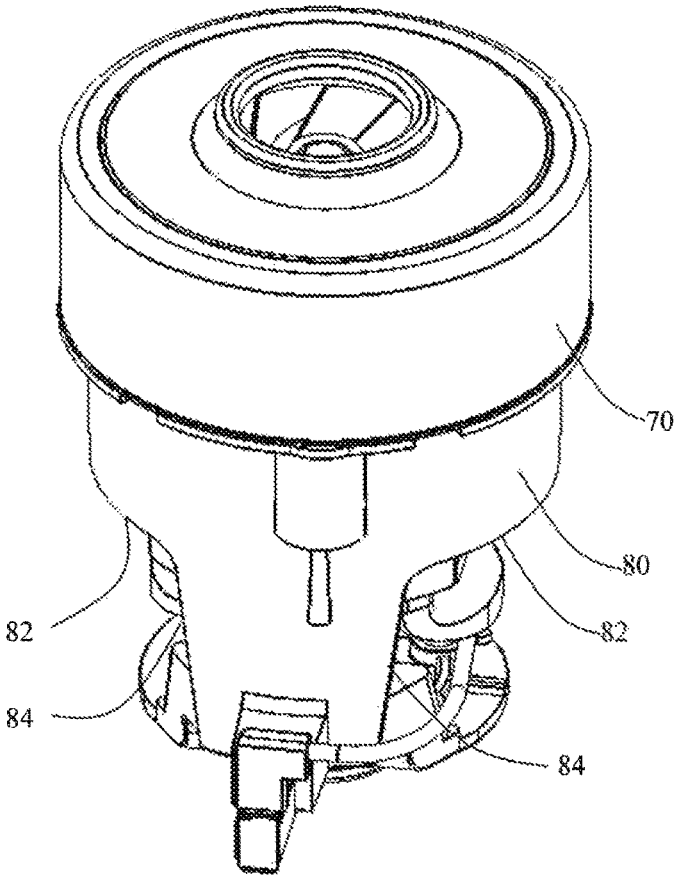
FIG. 8 illustrates the blower of FIG. 5, complete with a motor housing.

FIG. 5 illustrates a blower employing the above-described diffuser. The blower is shown in a partially assembled state without motor windings and a motor housing, for ease of understanding. FIG. 6 is a sectional view of the blower of FIG. 5 with a motor removed. FIG. 7 is a top view of the blower of FIG. 5 with an outer housing and an upper plate of an impeller removed. FIG. 8 illustrates the blower of FIG. 5 complete with the motor housing assembled.

Referring to FIG. 5 and FIG. 6, the blower includes a motor 30, an impeller 50 fixed to an output shaft 32 of the motor 30, a diffuser 10 fixed to the motor 30, and an outer housing 70 that houses the impeller 50 and the diffuser 10.

The impeller 50 includes a lower plate 52, an upper plate 54 and blades 56 disposed between the lower plate 52 and the upper plate 54. The lower plate 52 is fixedly mounted to one end of the output shaft 32 of the motor 30 by a screw nut or other known fastening means. A hole in the upper plate 56 centrally forms an air inlet 58. The outer housing 70 forms an opening 72 corresponding to the air inlet 58 of the upper plate 56, for entry of the airflow.

The diffuser 10 is disposed below the lower plate 52 of the impeller, i.e. on the side of the impeller 50 where the motor 30 is located. The body 12 of the diffuser 10 forms a center through hole 125, and a bearing seat 127 is disposed at the air outlet side of the body 12. A bearing 129 is mounted in the bearing seat 127. Preferably, the bearing 129 is a ball bearing with an outer ring abutting against the air outlet surface 124 of the body 12 and an inner ring fitted to the output shaft 32. The end of the output shaft 32 of the motor 30 extends through the through hole 125 to join with the impeller 50. The mounting posts 130 are fixedly connected to a stator core of the motor 30. An axial positioning structure 60 is further disposed between the diffuser 10 and the impeller 50. Specifically, the positioning structure 60 is a positioning plate having a center through hole and a flange 62 formed around an edge of the through hole. The flange 62 of the positioning plate 60 is inserted into the through hole 125 of the diffuser 10 to abut against an inner ring of the bearing 129. The lower plate 52 of the impeller is captured between the positioning plate and the screw nut fitted to the end of the output shaft.

Referring to FIG. 7, preferably, an outer edge of the lower plate 52 of the impeller 50 extends beyond the inner edge of the terminating end of the guide surface 142, and an outlet angle θ of the blades 56 of the impeller 50 (i.e. the angle formed between a tangent line of the blade at a terminating end thereof and a tangent line of a circle at the terminating end of the blade, wherein the circle has a center at a center of the impeller and a radius equal to the distance between the terminating end of the blade and the impeller center) ranges between 22 to 35 degrees. This configuration allows the guide surface 142 of the diffuser 10 to be matched with the impeller 50, such that the airflow out of the impeller 50 can smoothly flow over the guide surface 142 of the diffuser 10, thus enhancing the efficiency of the blower.

Preferably, the motor 30 is a universal motor. During operation of the motor 30, the impeller 50 is driven by the motor output shaft 32 to generate the airflow. The airflow enters the housing 70 via the opening 72, enters the impeller 50 via the air inlet 58, and flows out of the impeller 50 via passages formed between the blades 56. The airflow in turn flows from the air inlet side (i.e. the near-impeller side) to the air outlet side (i.e. the near-motor side) of the diffuser 10 along the guide surface 142 of the diffuser 10.

Referring to FIG. 8, the blower further includes a motor housing 80 for mounting the motor 30. One end of the housing 80 is fixed to the outer housing 70, and the other end forms a plurality of air ports 82. Preferably, the motor housing 80 forms a pair of diametrically-opposed air ports 82 each including a pair of outwardly inclined sides 84. The motor comprises a pair of diametrically-opposed brushes. The brushes do not align with the air ports of the motor housing. The airflow flowing over the motor 30 flows out of the housing 80 via the air ports 82. The blower creates a vacuum at the inlet and pressurized airflow at the air ports.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A diffuser comprising: a plate-shaped body, the body comprising an air inlet side and an air outlet side;

a plurality of diffusion blades disposed at a circumferential edge of the body, each of the diffusion blades comprises an inclined guide surface, the guide surface having a starting end at the air inlet side of the body and a terminating end at the air outlet side of the body, the guide surface extending from the starting end to the terminating end along a circumferential path of the body and has a width gradually increasing from the starting end to the terminating end, each of the diffusion blades further comprising a sloping surface extending from the terminating end of a corresponding one of the guide surfaces toward the air inlet side of the body; and a plurality of air outlets at ends of the sloping surfaces of the diffusion blades, each of the air outlets fluidly connects the end of a corresponding one of the sloping surfaces and the air outlet side of the body, wherein the body comprises an air inlet surface at the air inlet side, and the guide surface is inclined with respect to the air inlet surface at an inclination angle ranging between 18 to 25 degrees.

2. The diffuser of claim 1, wherein each of the diffusion blades further comprises a curved connecting wall interconnecting an inner edge of the guide surface and the body, the curved connecting wall comprises a starting end connected with the starting end of the guide surface and a terminating end connected with the end of the sloping surface, and the connecting wall gradually departs from an outer edge of the guide surface to form the curved shape.

3. The diffuser of claim 2, wherein the curved connecting wall comprises a plurality of curved sections having different radii of curvature.

4. The diffuser of claim 2, wherein the curved connecting wall has an inlet angle ranging between 16 to 23 degrees.

5. The diffuser of claim 2, wherein the curved connecting wall has an outlet angle ranging between 28 to 36 degrees.

6. The diffuser of claim 1, wherein the body comprises an air outlet surface at the air outlet side, and an outer circumferential surface interconnecting circumferential edges of the air inlet surface and the air outlet surface, a projection of the outer circumferential surface along a center axis of the body is a circle in shape, and outer edges of the guide surfaces of the diffusion blades are located on the circle.

7. The diffuser of claim 1, wherein the body comprises an air outlet surface at the air outlet side, the air outlet surface defines a cavity in flow communication with the air outlets.

8. The diffuser of claim 7, wherein each of the diffusion blades further comprises an outer wall extending from a rim of a corresponding one of the air outlets along an outer edge of a corresponding one of the guide surfaces.

9. A blower comprising: a motor having an output shaft; an impeller fixed to the output shaft to be driven to generate an airflow; and the diffuser of claim 1 disposed downstream of the impeller in the direction of the airflow and an outer housing that houses the impeller and diffuser.

10. The blower of claim 9, wherein the impeller comprises a plurality of fan blades, each of the fan blades having an outlet angle ranging between 22 to 35 degrees.

11. The blower of claim 9, further comprises a motor housing for mounting the motor, one end of the housing is fixed to the outer housing, and the other end of the motor housing forms a pair of diametrically-opposed air ports.

12. The blower of claim 11, wherein the motor is a universal motor comprising a pair of diametrically-opposed brushes, the brushes deviating from the air ports of the motor housing.

* * * * *